US005806282A

United States Patent [19]

Hansen

[11] Patent Number: 5,806,282

[45] Date of Patent: Sep. 15, 1998

[54] FILLING MACHINE HAVING A CONTINUOUS PARTICLE MONITORING SYSTEM

[75] Inventor: David Hansen, St. Paul, Minn.

[73] Assignee: Tetra Laval Holdings & Finance, SA, Pully, Switzerland

[21] Appl. No.: 828,353

[22] Filed: Mar. 28, 1997

[51] Int. Cl.[6] ..... B65B 1/28; B65B 31/02

[52] U.S. Cl. ..... 53/432; 53/453; 53/467; 53/471; 53/510; 53/511; 53/281; 53/52; 53/167; 141/51

[58] Field of Search ..... 53/428, 433, 452, 53/453, 467, 471, 558, 559, 281, 282, 167, 510, 511, 52; 141/51, 53

[56] References Cited

U.S. PATENT DOCUMENTS

| | | | |
|---|---|---|---|
| 4,055,035 | 10/1977 | Sjostrand et al. | 53/167 |
| 4,249,244 | 2/1981 | Shofner et al. . | |
| 5,069,017 | 12/1991 | Fabricius | 53/167 X |
| 5,097,649 | 3/1992 | Ueda et al. | 53/167 |
| 5,282,151 | 1/1994 | Knollenberg . | |
| 5,319,575 | 6/1994 | Lilienfeld . | |
| 5,488,811 | 2/1996 | Wang et al. | 53/52 |
| 5,673,535 | 10/1997 | Jagger | 53/167 X |

*Primary Examiner*—Horace M. Culver
*Attorney, Agent, or Firm*—Michael A. Catania

[57] ABSTRACT

A continuous particle monitoring system for use in a filling machine is provided. The filling machine has a plurality of processing stations in which containers are conveyed to each processing station to execute at least one process to collectively form, fill and seal each container. The filling machine also includes an air intake in fluid communication with a clean air supply. A chamber is connected in fluid communication with the air intake to receive the clean air supply. The particle monitoring system is constructed and arranged to monitor the clean air supply within the chamber. To this end, the particle monitoring system includes a sampling probe arranged in the chamber and oriented anisoaxially with respect to the clean air supply. The sampling probe preferably includes a substantially tubular body having a sampling port arranged at an end thereof. Also, a mounting plate for securing the probe within the filling machine is formed in the tubular body. A sampling line connection point is arranged at another end of the tubular body in fluid communication with the sampling port. The sampling probe is connected via a sampling line to a particle counter. A vacuum pump draws an air sample through the probe and into the counter to continuously monitor the air quality in the filling station of the filling machine.

28 Claims, 8 Drawing Sheets

FILLING MACHINE HAVING A CONTINUOUS PARTICLE MONITORING SYSTEM

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to an apparatus for filling containers, and more particularly, to a continuous particle monitoring system for a filling machine. The continuous particle monitoring system automatically and continuously monitors the air quality within the filling zone in the filling machine. The particle monitoring system advantageously operates during production cycles and can remain in the filling machine during cleaning operations without operator intervention.

Current packaging machine integrate various components necessary to fill and seal a container into a single machine unit. Such a packaging machine is used to perform a packaging process, which generally stated, includes feeding carton blanks into the machine to form cartons, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine." The machine disclosed in that patent includes a plurality of processing stations, each station implementing one or more processes to form, fill, and seal the containers. Each of the processing stations is driven by one or more servomotors that drive the various components of each of the processing stations.

Another type of packaging machine is exemplified by the TR/7™ and TR/8™ packaging machines manufactured and available from Tetra Pak, Inc. Such machines are of a more conventional type in which many of the components are driven from a common drive motor through, for example, indexing gears and cam mechanisms.

Known form, fill and seal filling machines usually incorporate various stations. Typically, a carton forming station is arranged prior to a sterilizing station, which is followed by a filling station and a sealing station. Depending on the product to be dispensed, the environment surrounding the filling station is maintained at a highly hygienic or sterile level. The filling station typically requires the highest level of hygiene since the liquid product is exposed while the container is being filled. As a result, the sterility of this region is critical. Such a level of hygiene may be accomplished by enclosing the filling station in a sterile chamber within the filling machine. To ensure and maintain the hygienic level, a continuous monitoring of the filling station region may be necessary.

Problems occur in currently-known systems that provide different stations in the filling machine. For example, these machines have difficulty controlling the air quality and desired air pressures within the machine. As set forth above, different levels of air quality need to be maintained as needed in certain areas requiring different levels of hygiene. If the hygienic level falls below an acceptable standard, the filling operation should be halted until proper hygiene can be re-established. To ensure sufficient air quality consistent with the hygiene level required during filling operations, the quality of air must be continuously monitored.

Furthermore, certain systems having internal air flow experience turbulent portions of the air flow which cause hygiene problems in the filling machine. For example, uneven air flow in certain locations allows settling regions for debris and liquid accumulation in the machine. Additionally, recirculation zones in the machine may allow sterile or clean air to become recontaminated and then reinfect the unsealed packaged product. An apparatus for continuously monitoring the particles in the filling machine is needed to detect a lack of proper hygienic conditions.

Also, some filling machines have multiple container paths in a single machine. A consequence of the increased throughput is possible cross-contamination between container paths. In addition, one path may be within acceptable hygienic levels, while the other is not. To account for the different levels of hygiene, an apparatus for continuously measuring the particles in the different container paths on an independent basis is needed.

Finally, regulatory guidelines used in the establishment and verification of clean rooms/mini-environments require ongoing testing of the air quality within the controlled area. By incorporating an automated continuous particle monitoring system into the controlled area, this testing and ongoing validation may be accomplished without direct operator intervention. This provides several advantages over manual sampling, including: repeatable and consistent sampling; continuous sampling during the filling process; a fully automated system independent of the operator; and maintenance of the integrity of the sterile zone (by not requiring operators to enter the chamber to perform manual tasks). These features help to further ensure the level of hygiene in the filling machine.

BRIEF SUMMARY OF THE INVENTION

A carton filling machine comprising a continuous particle monitoring system is provided. The filling machine includes a clean air system for providing a downward flow of clean, sterile air into a chamber that substantially encloses one of the machine stations. Preferably, the enclosed machine station is a filling station. Even more preferably the clean air system encloses both the fill pipe of the filling station and a top folding portion of a top sealing station of the machine. The top folding portion of the top sealing station ensures that the carton exits the chamber in a closed state whereby the carton is maintained in a very hygienic state after it has been filled in a very hygienic atmosphere. The air flow is advantageously divided into plural streams, one of which is directed about the fill pipe to further ensure sterile filling conditions. The continuous particle monitoring system ensures the sterile filling conditions by continuously monitoring the air quality of the sterile chamber.

In accordance with one embodiment of the continuous particle monitoring system, the system is utilized in a filling machine having a plurality of processing stations wherein a plurality of containers are conveyed to each processing station to execute at least one process to collectively form, fill and seal each container. The filling machine also includes an air intake in fluid communication with a clean air supply. A chamber is connected in fluid communication with the air intake to receive the clean air supply. The particle monitoring system is constructed and arranged to monitor the clean air supply within the chamber. To this end, the particle monitoring system includes a sampling probe arranged in the chamber. The sampling probe is oriented anisoaxially with respect to the clean air supply. In an embodiment, the sampling probe comprises a substantially tubular body having a sampling port arranged at one end and a sampling line connection point at another end of the tubular body. The sampling line connection point is connected in fluid communication with the sampling port. Also, a mounting plate for securing the probe within the filling machine is formed in the tubular body. The sampling probe is connected via a sampling line to a particle counter. A vacuum pump draws an air sample through the probe and into the counter to continuously monitor the air quality in the filling station of the filling machine.

A method of monitoring air quality in a filling machine having a plurality of processing stations is also provided. A plurality of containers are conveyed to each processing station to execute at least one process to collectively form, fill and seal each container. The filling machine including a chamber arranged to receive a clean air supply. In an embodiment, the method comprises the steps of providing a particle monitoring system having a pump connected in fluid communication to a sampling probe via a particle counter; arranging the sampling probe anisoaxially with respect to the clean air supply in the chamber; generating a vacuum using the pump to draw a portion of the clean air supply into the particle counter via the sampling probe; and measuring a particle count using the particle counter.

It is an advantage of a filling machine having a continuous particle monitoring system to provide automatic and continuous particle monitoring of the air quality at critical locations of the filling machine. For example, such critical locations in the filling machine include sterile areas such as the fill system located prior to the final sealing station for the carton.

The arrangement of the components of the continuous particle monitoring system enables automatic cleaning methods and equipment to be used. To this end, certain components of the particle monitoring system are remotely located to avoid interfering with the automatic cleaning equipment.

A further advantage of the continuous particle monitoring system is protecting the particle counters from possible contamination resulting from a carton crash, cleaning operations or a chemical splash. To this end, in an embodiment, certain components of the particle monitoring system are remotely located, and the probe is precisely located and defined, to prevent liquid product or chemicals from contaminating the particle counter.

Yet another advantage of the continuous particle monitoring system is that the particle sampling probes are oriented in the substantially vertical air flow in the sterile chamber to provide a sufficient aspiration efficiency. To this end, an embodiment includes sampling probes mounted in the region of the fill pipes. In addition, a further advantage of the sampling probes is that they are self-draining.

Still another advantage of the continuous particle monitoring system is the independent monitoring of the separate container conveyor paths in the filling machine. To this end, the sampling probes are arranged on respective sides of a dividing wall constructed between the two container conveyor paths.

DETAILED DESCRIPTION OF THE INVENTION

A filling machine having a continuous particle monitoring system to provide automatic and continuous monitoring of the air quality within a filling machine is provided. In particular, the air quality of a sterile chamber surrounding the filling station is continuously monitored. The continuous particle monitoring system is arranged to enable particle monitoring during operation of the filling machine. As an additional benefit, no operator intervention is needed, so the sterile chamber remains undisturbed.

Figure 1:
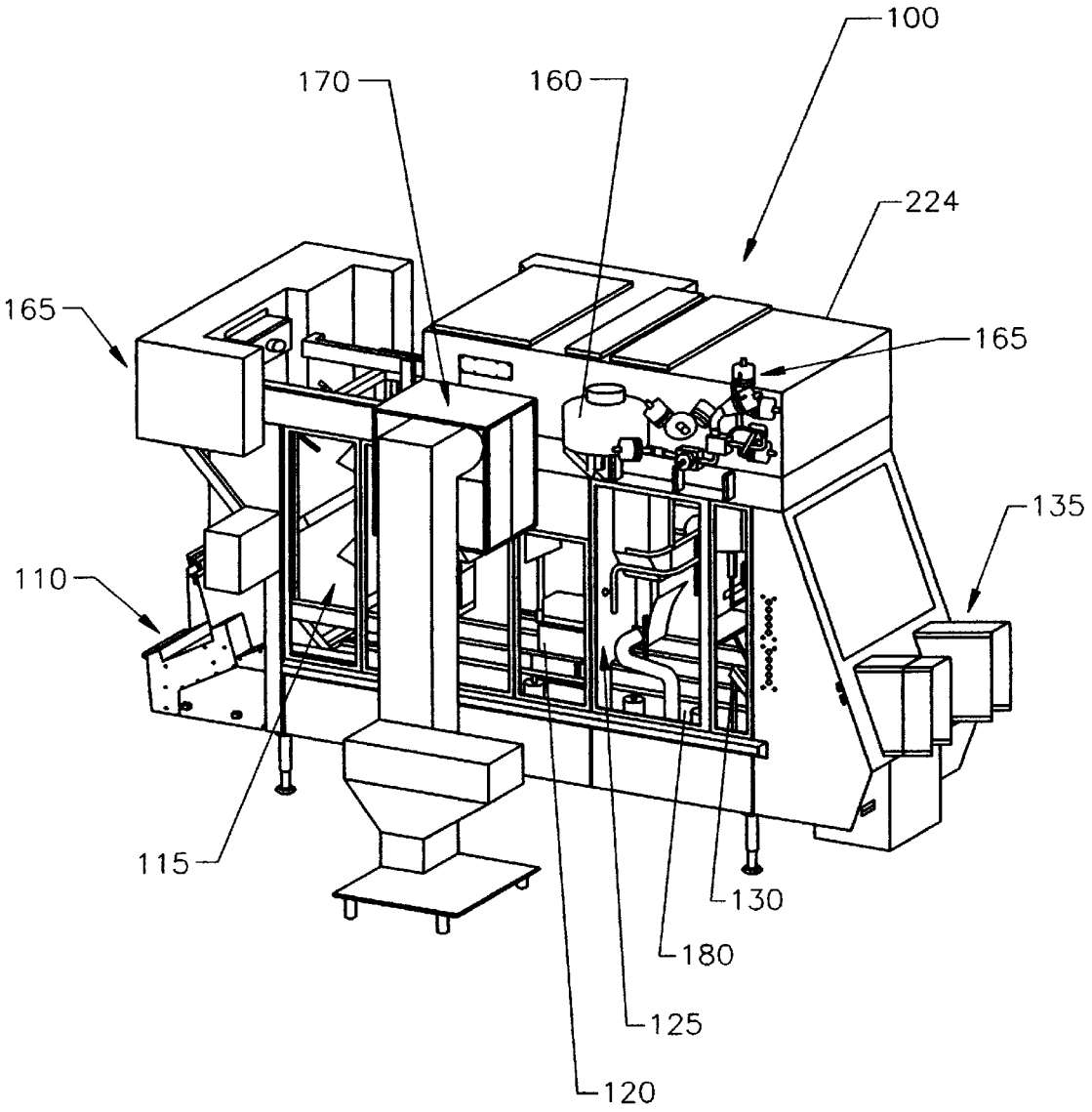
FIG. 1 is a perspective view of an embodiment of a filling machine incorporating a continuous particle monitoring system of the present invention.
Figure 2:
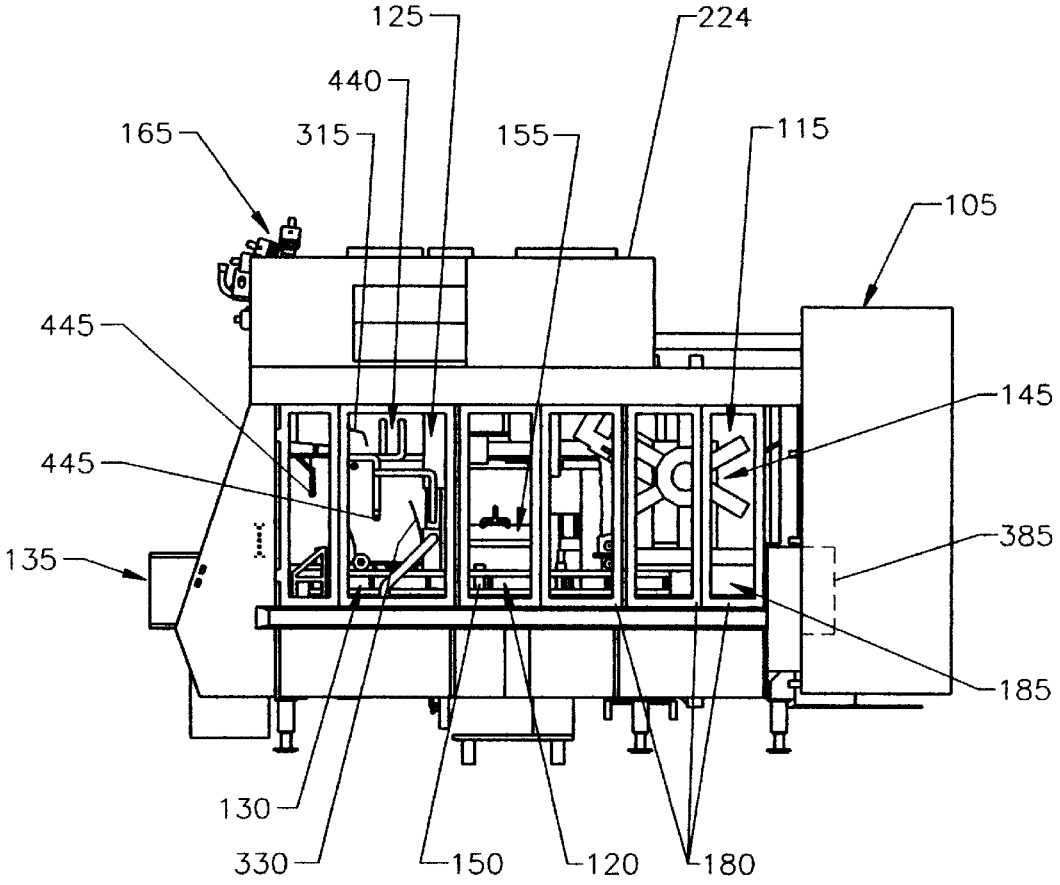
FIG. 2 is a side view of the embodiment of the filling machine of FIG. 1 incorporating the continuous particle monitoring system.
Figure 3:
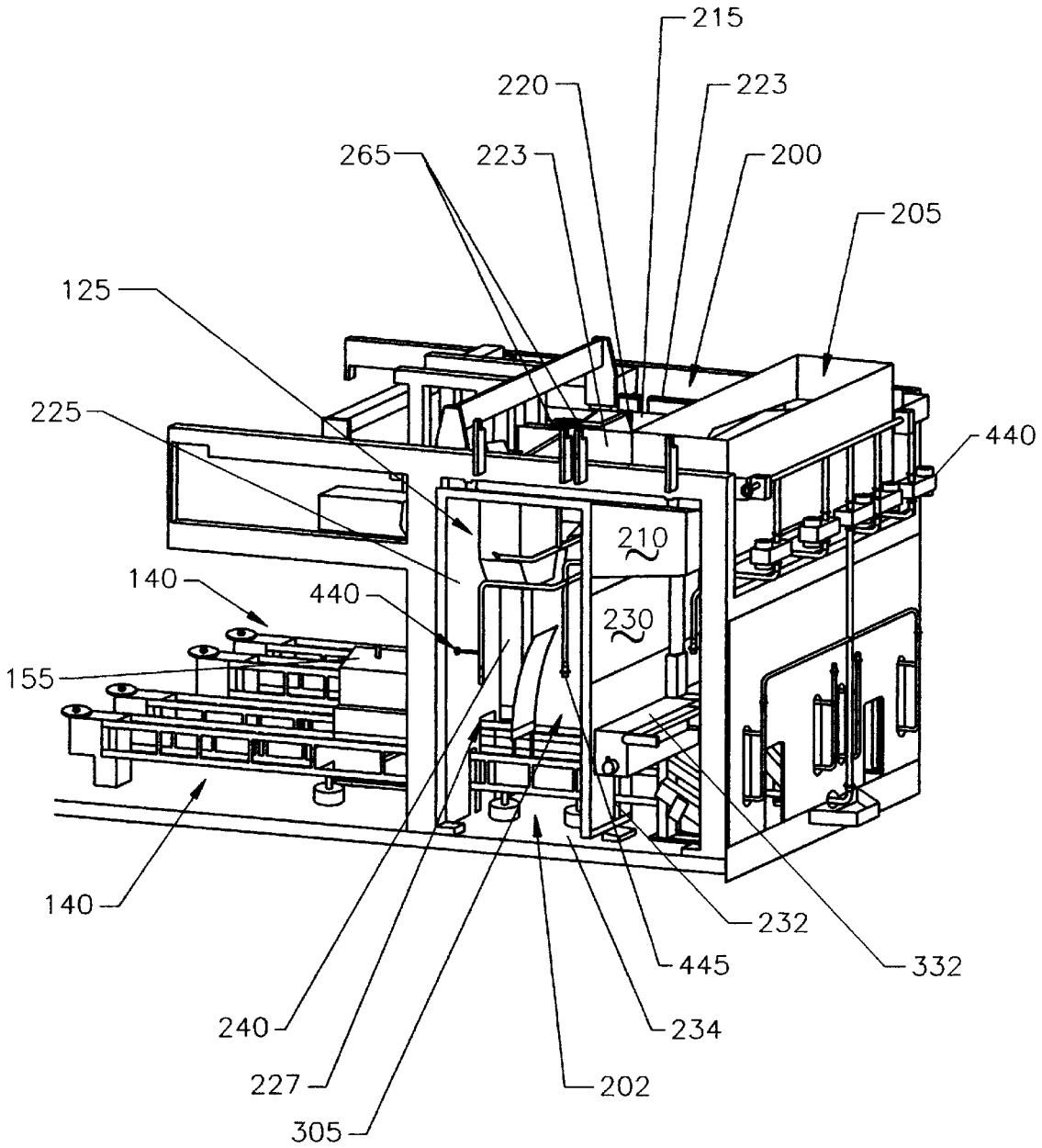
FIG. 3 is a perspective view of the embodiment of the filling machine of FIG. 1 with components removed illustrating the orientation of an embodiment of the continuous particle monitoring system within the machine.

To this end, a perspective view of a filling machine incorporating an embodiment of a continuous particle monitoring system is shown in FIG. 1. As illustrated in FIGS. 1–3, the filling machine, shown generally at 100, comprises a plurality of machine stations. In the illustrated embodiment, the stations are arranged sequentially within the filling machine 100 as follows: a carton magazine station 110, a carton forming station 115, a sterilizing station 120, a carton filling station 125, a carton sealing station 130 and a carton off-loading station 135. The cartons, gable-top cartons in the illustrated example, are transported between the carton forming station 115, sterilizing station 120, carton filling station 125, carton sealing station 130, and carton off-loading station 135 by a conveyor system 140. The machine stations are, for example, under the control of a control unit that is disposed in a control cabinet 105. The control unit monitors and controls the operation of the filling machine 100. Although the illustrated system is a dual-line machine, it will be recognized that the machine 100 may be constructed as a single line machine as well.

In operation of the machine 100, a supply of carton blanks are arranged at the carton magazine station 110. Individual carton blanks are erected and subsequently removed from the carton magazine station 110 and placed on a mandrel 145 located in the carton forming station 115. While on the mandrel 145, the erected cartons are rotated between subsequent bottom-sealing stations to form a carton having an open top and a sealed bottom. The carton thus has an open top as it enters the sterilizing station 120. At the sterilizing station 120, the cartons are subject to a hydrogen peroxide spray followed by UV irradiation by an ultraviolet light assembly 155 to sterilize the interior of the carton prior to filling with product.

Each sterilized carton is transferred from the sterilizing station 120 to the carton filling station 125 where it is filled with product. The product is provided to each carton through a pump and a fill pipe which are connected to receive product from a balance or intermediate storage tank 160 through a valve cluster 165. One example of such a valve cluster 165 is described in a patent application entitled "Interface Group for Aseptic and Non-aseptic Machines," U.S. Ser. No. 08/810613, and filed on even date herewith.

Once filled with product, each carton 150 is closed and sealed at the carton sealing station 130. The carton sealing station 130 comprises a top folder mechanism which, for example, uses a pair of opposed wheels to temporarily fold and seal the top of the carton. The top sealing station 130 further comprises a top sealer, such as an ultrasonic sealer, that hermetically seals the top of the carton. An example of such a carton sealing station 130 is disclosed in a patent application entitled, "Top Folding and Sealing Apparatus For Forming and Sealing the Fin of a Gabled Carton," U.S. Ser. No. 08/828,311, filed on even date herewith. Other top sealing mechanisms are likewise suitable for use in the illustrated machine. After the carton is filled and sealed, it is transferred out of the filling machine 100 at the off-loading station 135.

FIG. 1 also illustrates an optional screw cap applicator station 170 that is optionally provided to apply a screw cap to each carton. The screw cap applicator station 170 may be constructed in accordance with any known system. It may also include a cap sterilizing station such as the one disclosed in a patent application entitled "Filling Machine Having a Screw Cap Sterilization Apparatus and Method of Operating Same," U.S. Ser. No. 08/828,343, filed on even date herewith. Further, the filling machine 100 includes a plurality of doors 180 arranged to enclose the various stations. The doors 180 preferably have transparent portions 185 to allow observation of the operation of the individual stations.

Figure 4:
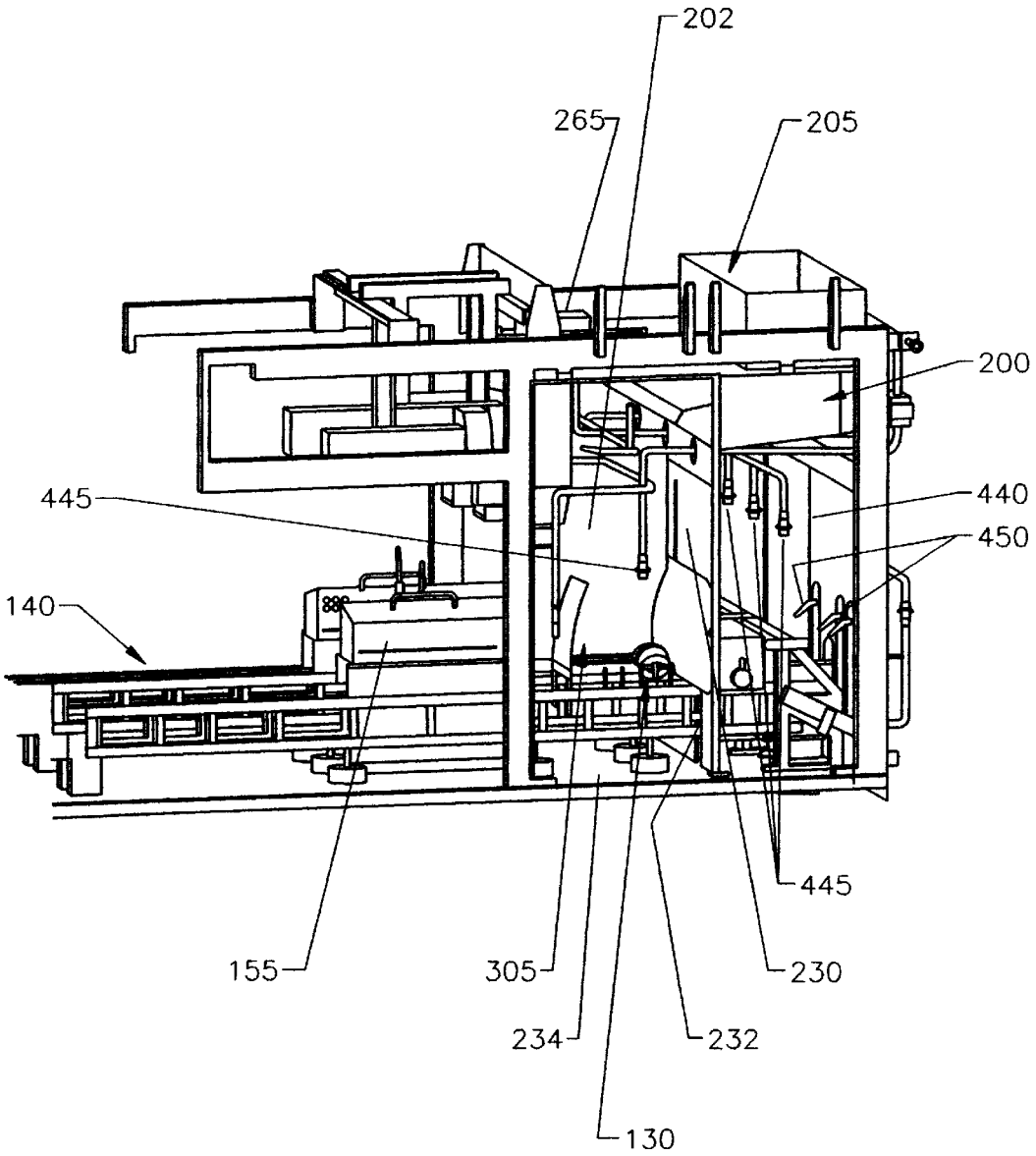
FIG. 4 is another perspective view of a filling machine with components removed illustrating the orientation of an embodiment of the continuous particle monitoring system within the machine.

FIG. 3 is a perspective view of the filling machine 100 with certain components removed (such as the doors 180, etc.) to more clearly illustrate a compartmentalized clean air system arranged therein. FIG. 4 is another perspective view similar to that of FIG. 3.

The compartmentalized clean air system is referenced generally at 200 and effectively encloses the fill station 125 within a positively pressurized chamber 202 having a downward flow of high quality air suitable for aseptic packaging. As will be evident from the following description, the downward flow of clean air is particularly directed about the fill pipe of the filling station so that the filling process is performed in a very hygienic atmosphere. Preferably, at least the top folding portion of the top sealing station is also enclosed in chamber 202.

As illustrated, the compartmentalized clean air system 200 includes an inlet aperture 205 that is part of an upper duct portion 210. The upper duct portion 210 is connected to or part of a roof portion 215 having a peak 220 in the center and sidewalls 223 that slope away from the peak 220 toward each lateral edge of the machine.

Inlet aperture 205 is connected to a source of clean air. With reference to FIGS. 1 and 2, this clean air source may be in the form of a microfiltrated air supply system 224 that is located atop the filling machine 100 over the roof portion 215. The air supply system 224 has an outlet that is connected in fluid communication with the inlet aperture 205. One example of such an air supply system 224 is disclosed in a patent application entitled "Filling Machine Having a Microfiltrated Air Supply System," U.S. Ser. No. 08/828,329, filed on even date herewith. Upper duct portion 210 opens to chamber 202 and includes one or more structures that assist in providing a downward flow of clean air through chamber 202.

In the illustrated embodiment, chamber 202 is defined by a pair of lateral walls that are comprised of glass doors 180 (see FIG. 1 and FIG. 2) and by a pair of transverse walls comprising an entrance wall 225 and an exit wall 230. The entrance wall 225 is substantially vertical and is arranged at the entrance of the chamber 202 enclosing the fill station 125. Entrance wall 225 includes at least one carton aperture 227 through which the cartons are conveyed by conveyor 140 into chamber 202. The exit wall 230 is also substantially vertical and is arranged at a distance from the entrance wall 225. Similarly, the exit wall 230 is provided with an outlet aperture 232 through which the cartons are conveyed by conveyor 140 to exit the chamber 202. The chamber 202 is defined at the upper portion thereof by the roof 215 and at the lower portion thereof by table 234. Thus, the entrance wall 225, the exit wall 230, the side glass doors 180, the table 234, and the roof 215 enclose and define the interior chamber 202. A fill pipe 240 of the filling station 125 is preferably the only component of the fill pump mechanism located in the chamber 202. The top folding portion of the top sealing station is preferably the only portion of the top sealing station that is disposed in the chamber 202. In cases in which the machine 100 is a dual-line machine, a divider wall 305 may be used to separate the fill lines within the chamber 202.

Figure 5:
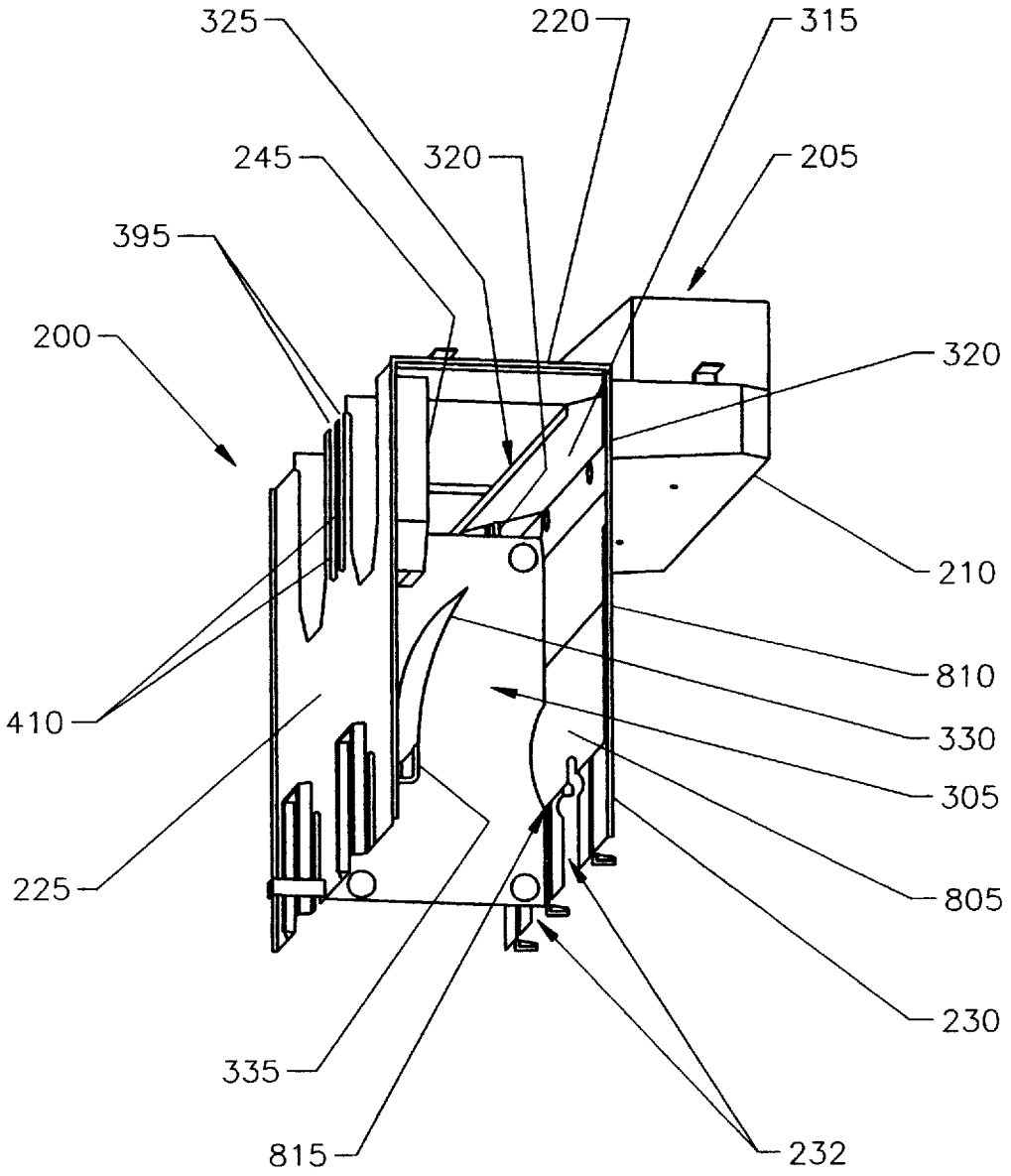
FIG. 5 is a perspective view of the clean air system incorporating an embodiment of the continuous particle monitoring system.

The system 200 includes various structures for directing the air flows within the chamber 202. In the illustrated embodiment of FIG. 5, an air foil 315 supported by a bracket 320 is arranged in the upper duct portion 210 and continues partially into the upper portion of chamber 202. The air foil 315 preferably includes a flap 325 to aid in the directing of the air flow. Additionally, a fill fin 330 is mounted to the entrance wall 225 within the chamber 202 by a bracket 335. The arcuate fill fin 330 acts to direct the air so that the air flow is increased proximate the fill pipe 240.

Figure 6:
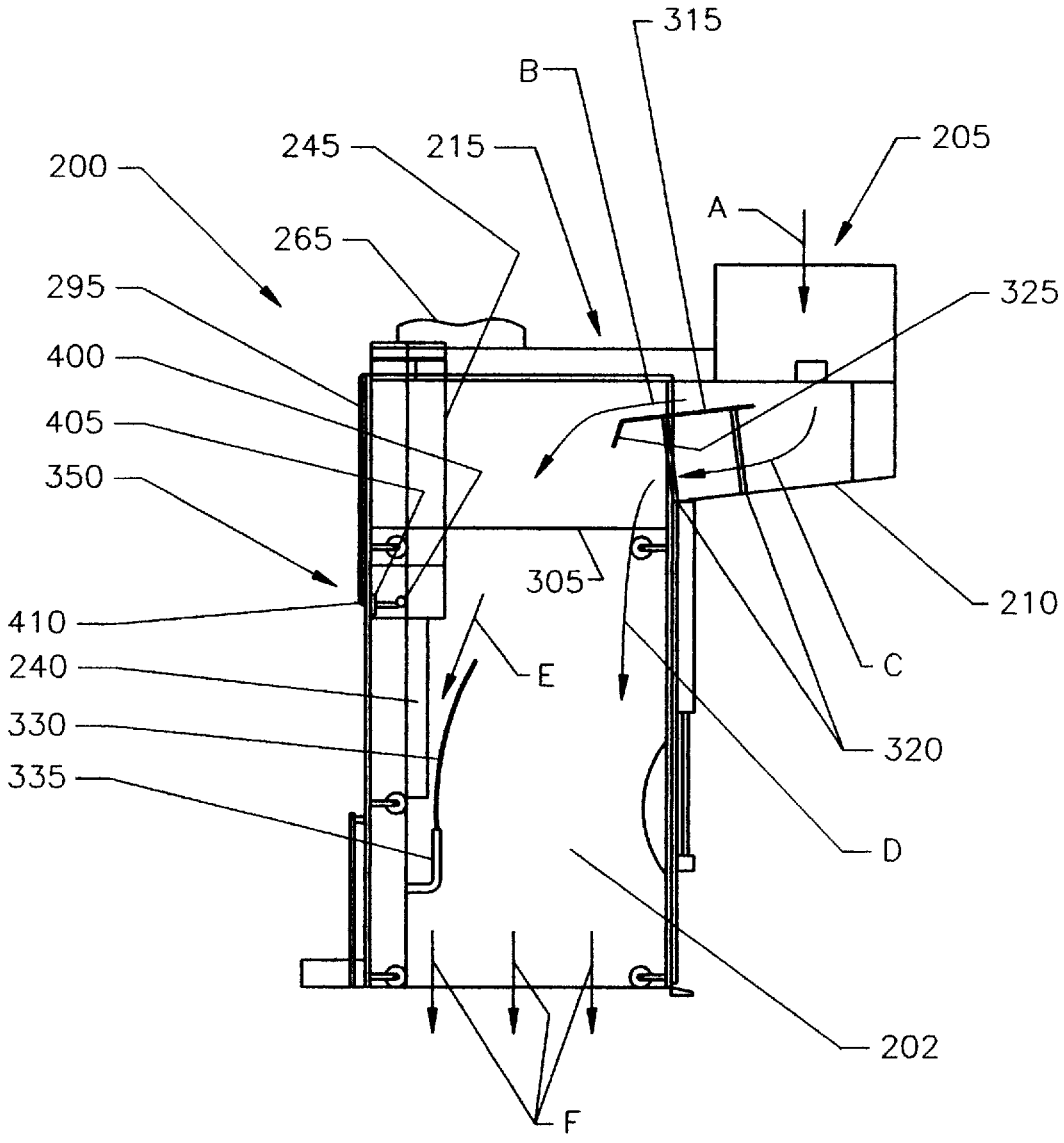
FIG. 6 is a side view of the compartmentalized clean air system incorporating an embodiment of the continuous particle monitoring system.

Operation of the clean air system 200 can be understood with suspect to FIG. 6. As shown, a supply of sterile air, indicated by arrow A, enters the system 200 through the inlet 205. The air supply A is deflected within the upper duct 210 and encounters the air foil 315. The air foil 315 substantially divides the air supply A into two paths B and C. Path B is directed into the chamber 202 and path C is deflected by the flap 325 on the air foil 315 substantially downwardly along the exit wall 230 as indicated by arrow D. A portion of the air from path B, referenced with arrow E, is captured and directed by the fill fin 330. The air in path E experiences an increase in velocity as a result of the curvature of the fill fin 330. Since the curvature of the fill fin 330 decreases the cross sectional area between the fill fin 330 and the entrance wall 225, the velocity of the air in path E must increase by Bernoulli's principle. The air passes out through the bottom of the filling machine 100 as indicated by arrows F.

As a result of the foregoing arrangement as described, a positive pressure exists in the chamber 202. Since the cartons have just been sterilized and product is present, the filling station and the top folding portion of the top sealing station are the regions requiring the greatest amount of hygienic control. The top folding portion of the top sealing station 130 effectively retains the top flaps of each container in a temporarily closed condition before final sealing by an ultrasonic sealer 332 locate exterior to the chamber 202. As such, the cartons are filled and effectively closed within chamber 202 and are never subsequently opened until opened by the consumer.

The continuous downward flow of air in the chamber 202, which results from the construction of the compartmentalized clean air system 200 as described, increases the hygiene of the chamber 202. Also, the increased velocity air flow in the region of the fill pipe 240 referenced at arrow E has the advantage of overcoming recirculation eddies caused by machine operation.

For example, during filling cycles the carton is lifted rapidly to meet the fill pipe 240 and subsequently lowered as the carton is filled. Such an operation may be carried out using a carton lifter apparatus as described in a patent application entitled Improved Seal for a Reciprocating Rod of a Packaging Machine, U.S. Ser. No. 08/825,207, and filed on even date herewith. While such a filling operation is beneficial for filling the cartons, the sudden and rapid movements of the carton and the lifter create localized disturbances and vortices which can introduce contaminants into the chamber 202 and the hygienic region of the filling station 125.

To overcome these localized recirculation paths, the fill fin 330 is constructed and arranged to increase the air flow in the region of the lifted carton. The air flow indicated at arrow E is sufficient to maintain a continuous downward flow in the area so that contaminants are kept out of the hygienic filling station 125.

In addition, the open architecture of the clean air system 200 reduces turbulence from the inlet 205, throughout the chamber 202, and out the bottom of the filling machine 100. Further, the divider wall 305 separates the two carton paths from each other and allows independent operation of the two lines. In addition, the arrangement of the divider wall 305 between the two carton paths advantageously reduces cross-flow and contamination.

Figure 7:
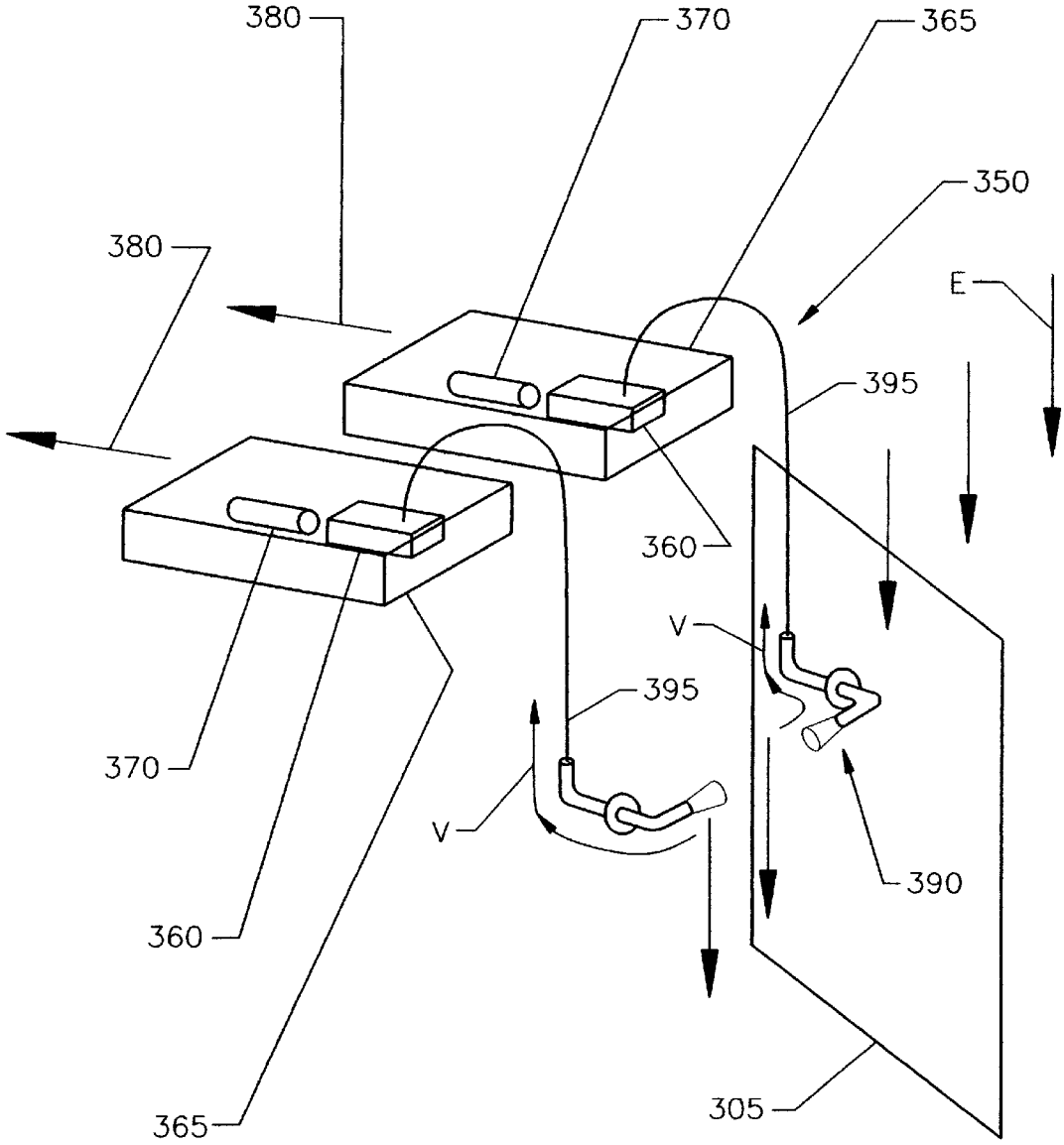
FIG. 7 is a perspective view of a schematic of an embodiment of the continuous particle monitoring system.

While the clean air system 200 advantageously provides the sterile chamber 202 with a near sterile environment for the filling operation, problems may occur that must be monitored. To this end, a continuous automatic particle monitoring system is provided. Referring to FIGS. 3 and 5–8, an embodiment of a continuous automatic particle monitoring system is illustrated generally at 350. In particular, FIG. 7 schematically illustrates an embodiment of the automatic and continuous particle monitoring system 350 and the relative orientation of the components of the system. Primary components of the system include a particle counter 360. The particle counter 360 is preferably arranged in a self-contained housing unit 365. The counter 360 also has a vacuum pump 370 and an interface connection 380 to a programmable logic controller (PLC) 385 located in the control unit cabinet 105 of the filling machine 100 (see FIG. 2). The particle counter 360 is preferably configured for 24 volt operation.

In a preferred embodiment, the pump 370 creates a vacuum which generates a metered flow of one cubic foot per minute (cfm) into the particle counter 360. This flow is indicated by arrows referenced V in FIG. 7. The metered flow may range from approximately 0.1 cfm to 2.0 cfm. The vacuum created by the pump 370 draws an aerosol sample into the particle counter 360 through a sampling probe 390 connected to the particle counter 360. The sampling probe 390 is connected in fluid communication with the particle counter 360 by a particle sampling line 395. The particle sampling line 395 is preferably 0.25 inch diameter, non-shedding Bevaline tubing available from Climet Instruments Company of Redlands, Calif.

In the preferred embodiment, the particle counter 360 incorporates various features. The particle counter 360 preferably incorporates laser diodes. Also, the particle counter 360 preferably operates using time-averaging of the particle counts. The time-averaging is a beneficial feature incorporated in the particle counter 360. In particular, when time-averaging is used during the counting of particles, the particle counter 360 is less susceptible to non-representative transient aerosol generation bursts which may distort an accurate particle count. In addition, alarm limits for indicating an excessive particle count are provided.

The interface connection 380 to the PLC 385 provides power, input/output (I/O) and feedback information between the particle monitoring system 350 and the PLC 385. The PLC 385 is used to help control the filling machine 100 in response to the information provided by the particle counter 360.

Typically, a particle counter sampling probe is arranged in an isoaxial direction (in-line with the predominant air flow direction). However, in the environment of the filling machine, such an arrangement might likely result in the ingestion of undesirable contaminants into the particle counters. For example, cleaning solution or product could enter the probe and cause damage to the sensitive particle counters.

Thus, in the past, operators have had to cap off the probes before a cleaning operation to avoid damage to the counters. Also, the cap must then be removed at a later time after the cleaning is done which creates a non-hygienic situation. The present automatic and continuous particle monitoring system overcomes the problems of known particle monitoring systems.

As shown in FIGS. 6 and 7, the sampling probes 390 in the preferred embodiment are arranged in an anisoaxial, anisokinetic configuration in the filling machine. The placement of the sampling probes 390 near the filling system 125 is advantageous since this area requires the greatest hygiene, since the product is exposed to open air while being dispensed from the fill pipe 240 to the carton. Further, the probes 390 are specifically designed to protect the sensitive particle counters 360 from the accidental ingestion of product, water, or cleaning chemicals. As illustrated, the probe 390 is arranged in the sterile chamber 202 near the filling system 125 of the filling machine 100 (see FIG. 6).

In view of the foregoing, the probes 390 are shaped and arranged to sample the air from the sterile chamber 202 in an anisoaxial, anisokinetic manner while still providing an acceptable aspiration efficiency that deviates from the efficiency of an in-line probe by only a minimal amount. The inventor herein performed extensive calculations and experiments to verify that the probe configuration of the present invention operates within acceptable levels. The probe 390 typically samples particle counts for aerodynamic particle diameters of greater than or equal to 0.3 $\mu$m. Since the probe is mounted in an anisokinetic and anisoaxial manner, the sampling is not at 100% aspiration efficiency. However, the inventor of the present application has performed theoretical calculations to evaluate the aspiration efficiency of the total system. The calculations take into account the theoretical aspiration efficiencies including probe effects, line losses, etc. The calculations prove that the effect of the anisoaxial and anisokinetic sampling is negligible with respect to line losses for the particle sizes of interest.

The inventor has calculated the aspiration efficiencies of the preferred sampling probe 390 such that the probe may be oriented to protect the counters 360 from the ingestion of splash product, cleaning chemicals, etc., and to allow the probe 390 to drain fluid while still providing an acceptable aspiration efficiency. A positive blowdown air flow within the sterile chamber 202 (illustrated in FIGS. 6 and 7, referenced by arrows E) has a particulate count which is measured by the counters 360 by utilizing the probes 390 arranged within the sterile chamber 202.

To prevent interference with the automatic cleaning and sterilizing system 440, the particle counter housing unit 365 may be arranged outside the sterile chamber 202. In the preferred embodiment shown in FIGS. 3 and 6, the housing unit 365 is mounted above the sterile chamber 202 in between the clean air system 200 and the clean air supply system 224.

As an additional feature to reduce sampling losses, the sampling lines 395 between the probe 390 and the particle counter 360 are kept relatively short to provide more accurate total sampling efficiencies. Thus, the short sampling lines 395 help to compensate for some of the reductions in the aspiration efficiency due to non-isoaxial, non-isokinetic sampling.

Figure 8:
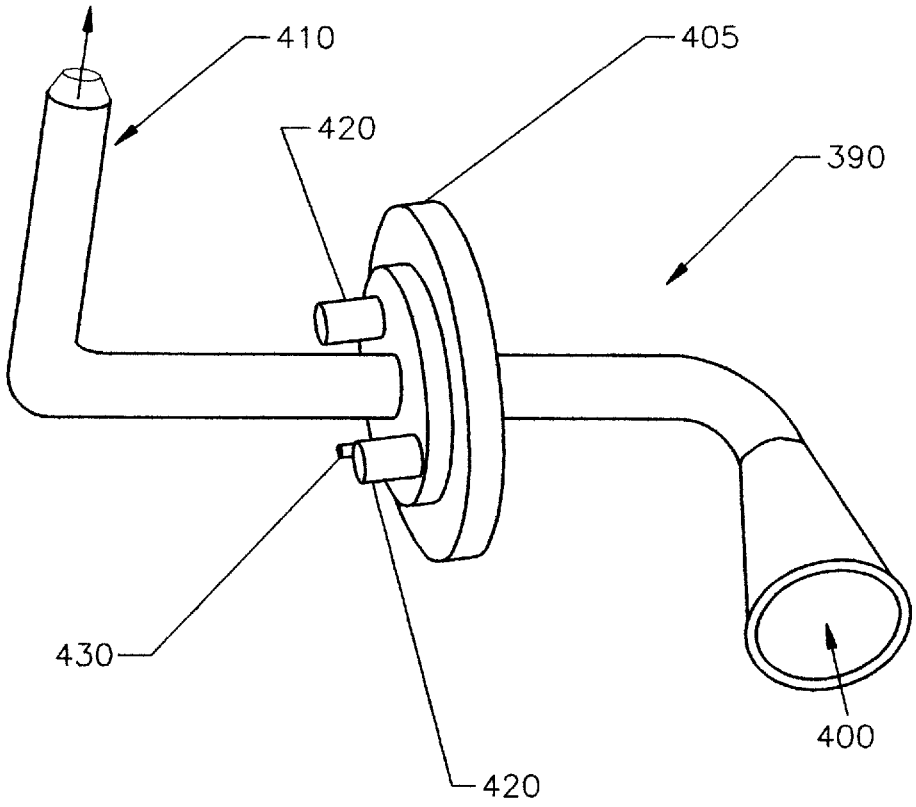
FIG. 8 is a perspective view of an embodiment of a sampling probe of the continuous particle monitoring system.

Turning now to FIG. 8, the features of the preferred embodiment of the probe 390 are illustrated. For example, the sampling probe 390 comprises a bent tubular body having a sampling port 400 into which particles are drawn by the vacuum created by the pump 370 in the counter 360. The probe 390 also includes a mounting plate 405 and a sampling line connector portion 410. The sampling line connector portion 410 is connected to the sampling line 395. The mounting plate 405 includes a securement 420, for example, a bolt. The securement 420 enables the probe 390 to be maintained in a fixed position. To further enhance this feature, the mounting plate 405 also incorporates a locating pin 430. The locating pin 430 inserts into a preselected, cooperating locating hole (not shown) to ensure that the probe 390 is mounted in the proper location and orientation within the filling machine 100 to maintain the aspiration efficiency and protect the particle counters.

Many filling machines, including the one illustrated, include more than one container conveying line. Specifically, FIG. 1 illustrates that two conveyor lines 140 are used in the embodiment of the filling machine 100. Thus, the dividing wall 305 is arranged in the sterile chamber 202 of the filling machine 100 as shown dashed in FIG. 7. Similar particle monitoring systems 350 are arranged on each side of the dividing wall 305, and therefore provide independent particle monitoring of each conveyor path 140. This is advantageous because one path may be contaminated while the other is operable and need not be shut down.

As described above, the embodiment of the continuous and automatic particle monitoring system 350 is additionally advantageous in that it is connected to the control unit 105 of the filling machine 100. When a preselected particle concentration is exceeded, an alarm will sound and the machine shuts down automatically. As a result, the operator can closely monitor the operation of the filling machine 100 and maintain quality control of filling operations.

An additional advantage and benefit of the embodiment of the continuous particle monitoring system 350 described above is the fact that it can monitor particles during operation and then be rendered dormant during the automatic cleaning and sterilization of the stations in the filling machine 100. As set forth above, the automatic cleaning system 440 includes spray balls 445 (see FIG. 1) comprehensively spray the stations, and in particular, the filling station 125 and the sealing station 130, with a cleaning solution. The continuous particle monitoring system 350, is arranged to not interfere with the automatic cleaning system 440. Conversely, the operation of the automatic cleaning system 440 does not interfere with the operation of the continuous particle monitoring system 350 since the sampling probes 390 are arranged anisoaxially and are self-draining. Also, the particle counters 360 are located outside the spraying area, which allows mutual operation of the particle monitoring and the cleaning systems.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A filling machine having a plurality of processing stations wherein a plurality of containers are conveyed to each processing station to execute at least one process to collectively form, fill and seal each container, the filling machine comprising:

an air intake in fluid communication with a clean air supply;

a chamber connected in fluid communication with the air intake to receive the clean air supply; and a particle monitoring system constructed and arranged to monitor the clean air supply within the chamber, the particle monitoring system including a sampling probe arranged in the chamber and oriented anisoaxially with respect to the clean air supply.

2. The filling machine of claim 1, further comprising:

a substantially vertical wall dividing the chamber into a first part and a second part.

3. The filling machine of claim 2, further comprising:

a first sampling probe arranged in the first part of the chamber and a second sampling probe arranged in the second part of the chamber of the filling machine.

4. The filling machine of claim 2, further comprising:

a first sampling probe arranged in the first part of the chamber and directed approximately at the vertical wall and a second sampling probe arranged in the second part of the chamber and directed approximately at the vertical wall.

5. The machine of claim 1, further comprising:

a cleaning system arranged substantially in the filling machine to clean the plurality of processing stations.

6. The machine of claim 1, wherein the chamber encloses at least one processing station.

7. The machine of claim 1, wherein the chamber encloses a filling station.

8. The machine of claim 1, wherein the chamber encloses a fill pipe.

9. The filling machine of claim 8, wherein the sampling probe is arranged in the chamber near the fill pipe.

10. The filling machine of claim 6, wherein the sampling probe is self-draining.

11. The filling machine of claim 6, wherein the sampling probe is arranged in an anisoaxial, anisokinetic configuration in the chamber.

12. The filling machine of claim 6, wherein the sampling probe further comprises:

a substantially tubular body having a sampling port arranged at an end thereof;

a sampling line connection point arranged at another end of the tubular body, the sampling line connection point connected in fluid communication with the sampling port; and a mounting plate formed in the tubular body.

13. The filling machine of claim 12, wherein the sampling probe further comprises means for mounting the sampling probe within the chamber.

14. The filling machine of claim 12, wherein the sampling probe further comprises a locating pin.

15. The filling machine of claim 1, wherein the particle monitoring system comprises:

a particle counter incorporating a vacuum pump; and an interface connected to a programmable logic controller (PLC) interconnected to the filling machine.

16. The filling machine of claim 15, further comprising a housing unit enclosing the particle counter.

17. The filling machine of claim 15, wherein the particle counter is arranged outside the sterile chamber.

18. The filling machine of claim 15, wherein the pump generates a metered vacuum to draw approximately one cubic foot per minute (cfm) of the clean air supply in through the sampling probe.

19. The filling machine of claim 1, further comprising:

a sampling line connecting the particle counter to the sampling probe.

20. The filling machine of claim 19, wherein the sampling line is approximately 0.25 inch diameter tubing.

21. The filling machine of claim 19, wherein the sampling line is connected to the sampling line connector portion of the sampling probe.

22. The filling machine of claim 15, wherein the particle counter further comprises an alarm indicating an excessive particle count.

23. The filling machine of claim 15, wherein the particle counter comprises a laser diode detection system.

24. The filling machine of claim 15, wherein the interface further comprises power, input/output (I/O) and feedback information transmitted between the particle monitoring system and the PLC.

25. The filling machine of claim 15, wherein the PLC controls the filling machine in response to information provided by the particle counter via the interface.

26. A method of monitoring air quality in a filling machine having a plurality of processing stations wherein a plurality of containers are conveyed to each processing station to execute at least one process to collectively form, fill and seal each container, the filling machine including a chamber arranged to receive a clean air supply, the method comprising the steps of:

providing a particle monitoring system having a pump connected in fluid communication to a sampling probe via a particle counter;

arranging the sampling probe anisoaxially with respect to the clean air supply in the chamber;

generating a vacuum using the pump to draw a portion of the clean air supply into the particle counter via the sampling probe; and measuring a particle count using the particle counter.

27. The method of claim 26, the method further comprising the steps of:

dividing the chamber into a first part and a second part;

providing a first and a second particle monitoring system, each having a pump connected in fluid communication to a respective first and second sampling probe via a respective first and second particle counter;

arranging the first sampling probe anisoaxially with respect to the clean air supply in the first part of the chamber;

arranging the second sampling probe anisoaxially with respect to the clean air supply in the second part of the chamber;

independently generating a vacuum using the pump to draw a portion of the clean air supply into the particle counter via the sampling probe in each system; and independently measuring a particle count in the first and second parts of the chamber using the respective particle counters.

28. The method of claim 26, wherein the filling machine includes an automatic cleaning system arranged therein to clean the processing stations, the method further comprising the step of:

automatically disabling the particle counters in preparation for an automatic cleaning system operation without physical intervention.

* * * * *